US010121327B1

(12) United States Patent
Hamud

(10) Patent No.: US 10,121,327 B1
(45) Date of Patent: Nov. 6, 2018

(54) SYSTEM, METHOD, AND DEVICE FOR CONDUCTING A WAGERING GAME

(71) Applicant: Garry Hamud, Las Vegas, NV (US)

(72) Inventor: Garry Hamud, Las Vegas, NV (US)

( * ) Notice: Subject to any disclaimer, the term of this patent is extended or adjusted under 35 U.S.C. 154(b) by 0 days.

(21) Appl. No.: 15/096,330

(22) Filed: Apr. 12, 2016

Related U.S. Application Data

(60) Provisional application No. 62/386,570, filed on Dec. 7, 2015.

(51) Int. Cl.
*G07F 17/32* (2006.01)

(52) U.S. Cl.
CPC ..... *G07F 17/3293* (2013.01); *G07F 17/323* (2013.01); *G07F 17/3227* (2013.01); *G07F 17/3267* (2013.01); *G07F 17/3288* (2013.01)

(58) Field of Classification Search
USPC ..... 463/12, 13
See application file for complete search history.

(56) References Cited

U.S. PATENT DOCUMENTS 8,702,100 B2 * 4/2014 Snow ..... A63F 1/12 273/149 R
2005/0051958 A1 * 3/2005 Snow ..... A63F 1/00 273/274
2006/0084506 A1 * 4/2006 Yoseloff ..... G07F 17/32 463/42
2007/0267811 A1 * 11/2007 Yoseloff ..... A63F 1/12 273/149 P
2010/0113120 A1 * 5/2010 Snow ..... G07F 17/32 463/16
2013/0023318 A1 * 1/2013 Abrahamson ..... G07F 17/3293 463/13

* cited by examiner

*Primary Examiner* — Pierre E Elisca
(74) *Attorney, Agent, or Firm* — Mark A. Litman & Associates, P.A.

(57) ABSTRACT

A hand wager and at least one partial hand wager are received. A player hand is dealt. As the player hand is dealt, the partial hand wager(s) may be resolved based on the partial player hands formed from a subset of the player hand. Specifically, partial player hands are compared to a pay table and a payout, if any, associated with the partial player hand is issued. The hand wager is resolved by comparing the player hand to the pay table. The player hand may be formed using replacement playing cards, community playing cards, or may be formed in any other way, depending on the optional embodiment. In an optional embodiment, a deck may be randomly selected from multiple decks prior to dealing a player hand. If the selected deck is a bonus deck, the pay table may be replaced with a bonus pay table.

6 Claims, 3 Drawing Sheets

SYSTEM, METHOD, AND DEVICE FOR CONDUCTING A WAGERING GAME

RELATED APPLICATION DATA

The present application claims the priority of U.S. Provisional Application Ser. No. 62/386,570, entitled "6+ ways to win poker, table or electronic," filed Dec. 7, 2015 by Applicant herein.

FIELD OF THE INVENTION

The present invention relates to wagering games. More specifically, the present invention includes a system, method, and computer device for conducting a wagering game in which a partial player hand dealt in the course of forming a player hand is rewarded if the partial player hand corresponds to a pay out on a pay table.

BACKGROUND OF THE INVENTION

A number of theories exist as to the origin of the game of poker. It is said by some authorities that Poker originates from the ancient Persian game of As-nas. The modern form of poker with its innumerable, different forms can be traced to the European game of Primero which was played with four cards per person and the cards were ranked in a complicated points system. In England, Primero was overtaken in popularity by a game called Brag of which there were many forms: three-card, five-card, seven-card and nine-card versions, the most popular being the three-card stud version. Wild cards were often used in Brag and were known as Braggers.

In modern casinos the game of poker takes one of three forms: live or cardroom poker where players compete against one another and the House charges a levy either in the form of a participation fee or as a percentage of winning hands; electronic video machines offering various games of poker, in particular, five card draw poker; and poker played as a "banker's game" either where the game involves players in contest with the dealer's hand or where the object is for players to obtain a hand based on hierarchical poker rankings, or games which combine the above two objects.

Live or cardroom poker games commonly available include Texas Hold'Em, Omaha, and seven-card stud. These games require considerable skill and a relatively large bankroll to have any expectation of success. As a result, most novice players avoid cardroom games.

Casinos have attempted to address this concern by providing poker-style table games that are house-banked and that require little expertise. Typical examples of such games are Caribbean Stud™, U.S. Pat. No. 4,836,553 and Let It Ride™, U.S. Pat. No. 5,417,430. Both games are based on five-card stud. In Caribbean Stud™, for example, the players' hands are pitted against the dealer's hand. In Let It Ride™, the sole objective is to form a winning hand based on a set of odds and a hierarchy of poker hand rankings.

Another example of a house-banked poker game is Three Card Poker™, U.S. Pat. No. 6,237,916. In Three Card Poker™, each player may place an ante wager, a "pairs plus" wager, or both wagers. The ante wager is a bet on the player's hand against the dealer's hand and the "pairs plus" wager is a bet on the ranking of the player's hand against a schedule of winning hands. After examining his hand the player may fold and forfeit his ante wager or continue play by placing a mandatory play wager equal to the ante wager. This is often referred to as a "bet or fold" decision. To be rewarded on both the ante and play wagers two conditions must be met: (1) the dealer must have a qualifying hand of a Queen high or better and (2) the player's hand must outrank the dealer's hand. If the dealer hand does not qualify, the player wins an even money award on the ante wager and the play wager is returned. If the dealer hand qualifies and outranks the player hand, the player loses both the ante wager and the play wager. If the player has made the "pairs plus" wager and his hand includes a winning hand based on a schedule of winning hands, he receives a pay out listed on the schedule.

SUMMARY OF THE INVENTION

The present invention includes systems, methods, and devices for conducting a wagering game. In one optional embodiment, a method may be conducted at a live table, electronic table, video gaming machine, kiosk, handheld device, cellular telephone, tablet, personal computer, or in any other fashion. In an optional embodiment conducted using a device, a device may include a data processor in communication with a display, a player interface, and a data storage device.

A method may be conducted using physical game pieces or electronic representations thereof. In one optional embodiment, the game pieces are playing cards. The game pieces are marked with at least one rank indicium. For example, in an optional embodiment in which the game pieces are playing cards, the playing cards may be marked with ranks of 2, 3, 4, 5, 6, 7, 8, 9, 10, Jack, Queen, King, and Ace. In an optional embodiment conducted using a device, electronic representations of game pieces may be stored at a data storage device.

In one optional embodiment, a method is implemented on an electronic gaming device having a logic controller, and a display, player interface, and a data storage device in communication with the logic controller. The data storage device stores electronic representations of at least one deck of playing cards, a pay table correlating hand rankings to pay outs for player hands and partial player hands, and program instructions executable by the logic controller.

In one optional embodiment, the program instructions are executable by the logic controller to receive a hand wager and at least one partial hand wager through the player interface. In an optional embodiment, multiple partial hand wagers are received for multiple partial hand resolutions. A player hand of playing cards is dealt in response to receipt of the hand wager. The player hand is dealt in at least two segments each consisting of at least one partial player hand.

At least one of the partial player hands is compared to the pay table between segments of dealing the player hand. In an optional embodiment, each of the partial player hand is compared to the pay table. For example, in one implementation, a five-card player hand is dealt one card at a time. After each card, the cumulative partial player hand is compared to the pay table (i.e., the one-card partial player hand formed by the first playing card dealt, the two-card partial player hand formed by the first and second playing cards dealt, the three-card partial player hand formed by the first, second, and third playing cards dealt, and so forth).

A pay out, if any, correlated to the partial player hand(s) compared to the pay table are issued based on the partial hand wager. In an example in which multiple partial player hands are dealt, a pay out is issued for each of the partial player hands corresponding to a pay out on the pay table.

Any partial hand wagers corresponding to partial player hands that are not correlated to a pay out according to the pay table are collected.

The player hand is compared to the pay table. A pay out, if any, correlated to the player hand is issued based on the hand wager. The hand wager is collected when the player hand is not correlated to a pay out according to the pay table.

In one optional embodiment, the data storage device is configured to store a plurality of decks of playing cards, including at least one bonus deck, and a bonus pay table different from the pay table. In one such optional embodiment, the logic controller randomly selects a deck prior to the beginning of the game. When the bonus deck is selected for conduct of the wagering game, the bonus pay table is used in place of the pay table.

DESCRIPTION

Reference is now made to the figures wherein like parts are referred to by like numerals throughout. The present invention is directed to a wagering game conducted using game pieces. The game pieces may take any form, including playing cards, tiles, dominoes, dice, or any other type of game piece.

For example, in one optional embodiment, the game pieces are playing cards. The playing cards may be conventional playing cards marked with a rank and a suit, with the ranks including deuce, three, four, five, six, seven, eight, nine, ten, Jack, Queen, King, and Ace and the suits including hearts, spades, diamonds, and clubs. Thus, in an embodiment of the game directed to using the suit rank indicia, a conventional fifty-two card poker deck of playing cards are marked with one of four rank indicia which identifies its membership within one of four suit groups.

Nevertheless, this should be interpreted as illustrative rather than limiting since a method according to the present invention may be conducted using a supplemented deck (a conventional poker deck including additional cards, such as Jokers), a truncated deck (a conventional poker deck excluding cards, such as a Spanish deck), or a modified deck (such as a poker deck with one or more conventional suits excluded, one or more additional suits added, one or more additional colors added, or the like) may be used.

Figure 1:
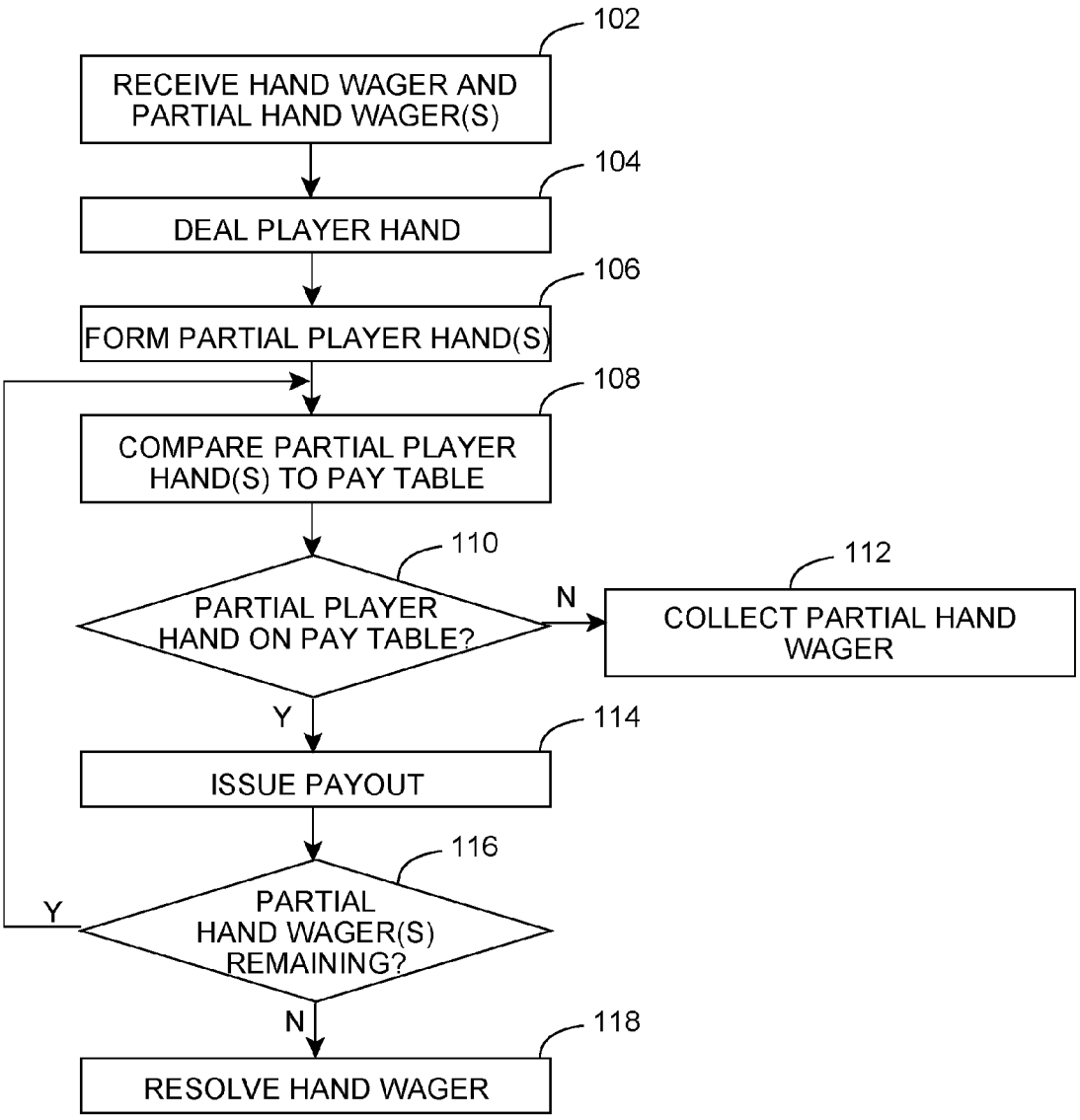
FIG. 1 is a flow chart of a method conducted according to an embodiment of the present invention.

In an optional embodiment illustrated in FIG. 1, a hand wager and at least one partial hand wager are received 102. In an optional embodiment, the hand wager is required for participation in the game while the partial hand wager(s) are optional. In another optional embodiment, one or more of the partial hand wager(s) are mandatory along with the mandatory hand wager. In an optional embodiment directed to a live table game, electronic table game, or the like, a hand wager and partial hand wager(s) may be placed using physical gaming chips, coins, currency, or the like. In an optional embodiment directed to an electronic device, the player may designate a hand wager and partial hand wager(s) using an input device associated with a player interface. The hand wager in an electronic game may be debited from a register of game credits stored by the electronic device.

In one optional embodiment, a player hand of playing cards is dealt 104. The quantity of playing cards making up a player hand may vary depending on the optional embodiment. For example, in an optional embodiment, a player hand of five playing cards may be dealt. The player hand may be dealt from a single deck of playing cards.

In the course of dealing the player hand, partial player hands are formed 106 using subsets of the playing cards dealt to the player hand. In one optional embodiment, the player hand is dealt in segments, with the playing cards cumulatively dealt at each segment used as a partial player hand. For example, in an example directed to five-card draw poker, the player hand may be dealt in one-card segments, with five partial player hands formed from the playing cards cumulatively dealt to the player hand at each segment, i.e., the one-card partial player hand formed by the first playing card dealt, the two-card partial player hand formed by the first and second playing cards dealt, the three-card partial player hand formed by the first, second, and third playing cards dealt, the four-card partial player hand formed by the first, second, third, and fourth playing cards dealt, and the five-card partial player hand formed by the first, second, third, fourth, and fifth playing cards dealt. The player hand wager may then be resolved based on the five-card player hand formed according to the rules of draw poker. Thus, in this case, six wagers may be resolved through a single player hand.

At least one partial player hand is compared 108 to the pay table. The pay table correlates various hand rankings for the partial player hand(s) and the player hand to pay outs. Optionally, the hand rankings may be poker hands. In an optional embodiment, a partial hand wager is received for each partial player hand formed, and each partial hand wager is resolved separately against the pay table. Thus, in the example of forming five partial player hands as a five-card player hand is dealt, five partial hand wagers may be received, with each partial hand wager resolved with five different partial hands compared to the pay table. Partial hand wagers are resolved by issuing 114 the pay out correlated to the partial player hand if the partial player hand appears 110 on the pay table. If a partial player hand is not on the pay table, the corresponding partial hand wager is collected 112. The process is repeated for each partial player hand until all partial hand wagers are resolved 116. An example pay table is illustrated in Table 1 below. It is noted that the pay table may vary in alternate optional embodiment, with different or additional hand rankings, different or additional pay outs, or the like.

TABLE 1

| | Pay out |
|---|---|
| One-Card Stud | |
| 10 or Better | 1.5 to 1 |
| Two-Card Stud | |
| Straight Flush | 6 to 1 |
| Any Pair | 4 to 1 |
| Any Flush | 1 to 1 |
| Three-Card Stud | |
| Straight Flush | 40 to 1 |
| Three of a Kind | 30 to 1 |
| Straight | 7 to 1 |

TABLE 1-continued

| | Pay out |
|---|---|
| Flush | 3 to 1 |
| Pair | 1 to 1 |
| Four-Card Stud | |
| 4 of a Kind | 250 to 1 |
| Straight Flush | 100 to 1 |
| Three of a Kind | 12 to 1 |
| Flush | 8 to 1 |
| Straight | 6 to 1 |
| Two Pair | 3 to 1 |
| Pair | 1 to 1 |
| Five-Card Stud | |
| Royal Flush | 1000 to 1 |
| Straight Flush | 600 to 1 |
| 4 of a Kind | 80 to 1 |
| Full House | 10 to 1 |
| Flush | 8 to 1 |
| Straight | 6 to 1 |
| 3 of a Kind | 4 to 1 |
| Two Pair | 2 to 1 |
| Pair | 0.5 to 1 |
| Five Card Draw | |
| Royal Flush | 1000 to 1 |
| Straight Flush | 50 to 1 |
| 4 of a Kind | 30 to 1 |
| Full House | 10 to 1 |
| Flush | 6 to 1 |
| Straight | 5 to 1 |
| 3 of a Kind | 3 to 1 |
| Two Pair | 2 to 1 |
| Jacks or Better | 1 to 1 |

The hand wager is resolved 118 by comparing the player hand to the pay table. In an optional embodiment, a player hand may be formed through additional steps beyond dealing the cards of the player hand. For example, in an optional embodiment directed to draw poker, an election may be received to hold or discard playing cards dealt to the player hand, with a replacement playing card dealt for each playing card discarded. After replacing discarded playing cards, the player hand is compared to the pay table to resolve the hand wager. In alternate optional embodiments, it is contemplated that the player hand may be a stud hand, that community cards could be dealt and/or utilized in forming the player hand, or any other process may be used to form a player hand.

Figure 2:
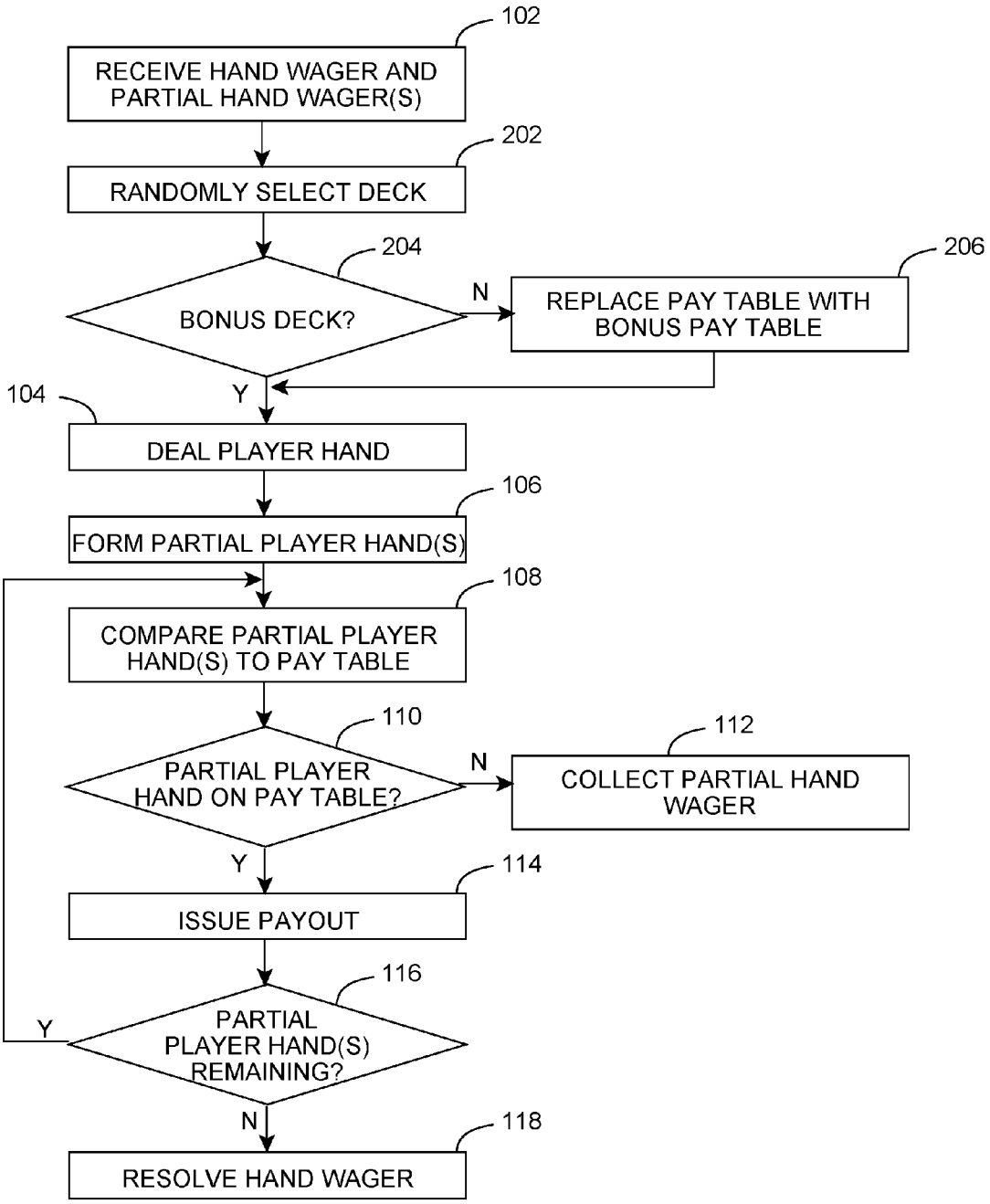
FIG. 2 is a flow chart of a method conducted according to an embodiment of the present invention.

In a further optional embodiment illustrated in FIG. 2, multiple different decks may be available for selection. At least one of the decks is a bonus deck. Prior to dealing any playing cards to the player hand, a deck is randomly selected 202. Depending on the deck selected, the pay table may be replaced with a bonus pay table. That is, if the deck selected is a non-bonus deck, the pay table is used without alteration. If the deck selected 204 is a bonus deck, the pay table may be replaced 206 with a bonus pay table. The decks may be distinguished by color. For example, regular decks associated with the pay table may be red, while a blue deck may be associated with a 2× bonus pay table and a green deck may be associated with a 5× bonus pay table. Of course, the ratio of bonus decks to regular decks, and the constitution of the bonus pay table may vary from embodiment to embodiment. For example, the bonus pay table may increase all or only some of the pay outs, add additional hand rankings and pay outs to the pay table, or the like.

Figure 3:
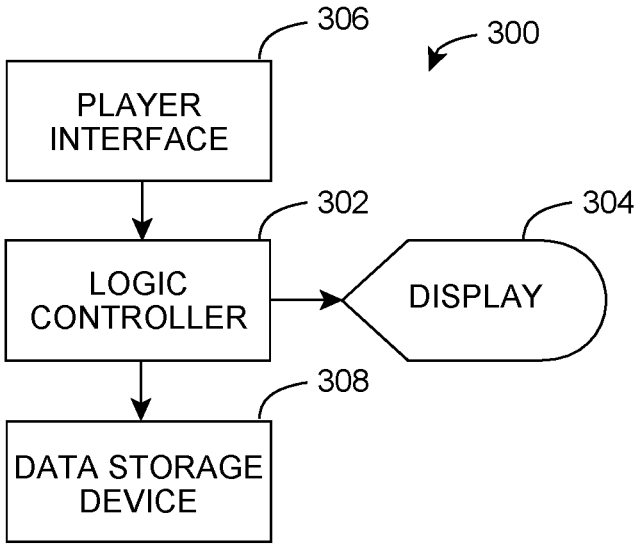
FIG. 3 is a block diagram of a device according to an embodiment of the present invention.

As discussed above and illustrated in FIG. 3, the present method could be implemented on a device 300, such as a cellular telephone, computer network (including, for example, the Internet), personal computer, electronic gaming machine, video card game machine, kiosk, handheld device, tablet, or any other type of device. In an optional embodiment, the device includes a logic controller 302 in communication with a data storage device 308 that stores electronic representations of playing cards, a pay table, and executable program instructions. The logic controller 302 also communicates with a display 306 and a player interface 304. In an optional embodiment, the display 306 and player interface 304 may be integrated into a single device such as a touch screen.

In one such optional embodiment, a hand wager and at least one partial hand wager may be received through a player interface 304. A logic controller 302 deals a player hand of playing cards (such as electronic representations of playing cards) and displays the player hand at the display 306. As the player hand is dealt, the logic controller 302 evaluates partial player hands by comparing the partial player hands to the pay table. The partial hand wagers are resolved based on the comparisons. As noted above, in one optional embodiment, the logic controller 302 may deal the player hand in segments, with a resolution of a partial hand wager between each segment. Thus, as five cards are dealt in one-card segments, five separate partial hand wagers may be resolved, along with a five-card draw poker hand wager that is resolved at the completion of the game.

In an optional embodiment, another dimension may be added to the game, with the data storage device 308 storing multiple separate decks, including at least one bonus deck. At the beginning of the game, a deck may be randomly selected by the logic controller 302. If a bonus deck is selected, the pay table may be replaced with a bonus pay table that has different (optionally larger) pay outs than the non-bonus pay table.

While certain embodiments of the present invention have been shown and described it is to be understood that the present invention is subject to many modifications and changes without departing from the spirit and scope of the invention presented herein.

I claim:

1. A method of conducting a wagering game using an electronic gaming device having a logic controller, display in communication with said logic controller, player interface in communication with said logic controller, and a data storage device in communication with said logic controller, wherein said data storage device is configured to store electronic representations of at least one deck of playing cards, a pay table correlating hand rankings to pay outs for player hands and partial player hands, and program instructions executable by said logic controller to conduct a method comprising:

receiving a hand wager and at least one partial hand wager through said player interface;

dealing a player hand of playing cards by said logic controller in response to receipt of said hand wager wherein said player hand is dealt in at least two segments consisting of at least one partial player hand;

comparing by said logic controller of at least one of said partial player hands to said pay table between segments of dealing said player hand;

issuing by said logic controller a pay out, if any, correlated to said at least one partial player hand compared to said pay table based on said partial hand wager;

collecting said partial hand wager by said logic controller when said at least one partial player hand compared to said pay table is not correlated to a pay out according to said pay table;

comparing said player hand to said pay table by said logic controller;

issuing by said logic controller a pay out, if any, correlated to said player hand based on said hand wager; and collecting said hand wager by said logic controller when said player hand is not correlated to a pay out according to said pay table.

2. The method of claim 1 wherein said data storage device is configured to store a plurality of decks of playing cards, including at least one bonus deck, and a bonus pay table different from said pay table, and said program instructions further comprise:

randomly selecting a deck by said logic controller; and when said at least one bonus deck is selected for conduct of said wagering game, utilizing said bonus pay table in place of said pay table.

3. An electronic gaming device comprising:

a logic controller;

a display in communication with said logic controller;

a player interface in communication with said logic controller; and a data storage device in communication with said logic controller, wherein said data storage device is configured to store electronic representations of at least one deck of playing cards, a pay table correlating hand rankings to pay outs for player hands and partial player hands, and program instructions executable by said logic controller to conduct a method comprising:

receiving a hand wager and at least one partial hand wager through said player interface;

dealing a player hand of playing cards by said logic controller in response to receipt of said hand wager wherein said player hand is dealt in at least two segments consisting of at least one partial player hand;

comparing by said logic controller of at least one of said partial player hands to said pay table between segments of dealing said player hand;

issuing by said logic controller a pay out, if any, correlated to said at least one partial player hand compared to said pay table based on said partial hand wager;

collecting said partial hand wager by said logic controller when said at least one partial player hand compared to said pay table is not correlated to a pay out according to said pay table;

comparing said player hand to said pay table by said logic controller;

issuing by said logic controller a pay out, if any, correlated to said player hand based on said hand wager; and collecting said hand wager by said logic controller when said player hand is not correlated to a pay out according to said pay table.

4. The electronic gaming device of claim 3 wherein said data storage device is configured to store a plurality of decks of playing cards, including at least one bonus deck, and a bonus pay table different from said pay table, and said program instructions further comprise:

randomly selecting a deck by said logic controller; and when said at least one bonus deck is selected for conduct of said wagering game, utilizing said bonus pay table in place of said pay table.

5. An electronic gaming device comprising:

a logic controller;

a display in communication with said logic controller;

a player interface in communication with said logic controller; and a data storage device in communication with said logic controller, wherein said data storage device is configured to store electronic representations of at least one deck of playing cards, a pay table correlating hand rankings to pay outs for player hands and partial player hands, and program instructions executable by said logic controller to conduct a method comprising:

receiving a hand wager and a plurality of partial hand wagers through said player interface;

dealing a player hand of playing cards by said logic controller in response to receipt of said hand wager wherein said player hand is dealt in a plurality of segments consisting of a plurality of partial player hands corresponding to said plurality of partial hand wagers;

comparing each partial player hand to said pay table by said logic controller between segments of dealing said player hand;

issuing by said logic controller each pay out, if any, correlated to each partial player hand compared to said pay table based on said partial hand wager;

collecting by said logic controller each partial hand wager corresponding to a partial player hand that is not correlated to a pay out according to said pay table;

comparing said player hand to said pay table by said logic controller;

issuing by said logic controller a pay out, if any, correlated to said player hand based on said hand wager; and collecting said hand wager by said logic controller when said player hand is not correlated to a pay out according to said pay table.

6. The electronic gaming device of claim 5 wherein said data storage device is configured to store a plurality of decks of playing cards, including at least one bonus deck, and a bonus pay table different from said pay table, and said program instructions further comprise:

randomly selecting a deck by said logic controller; and when said at least one bonus deck is selected for conduct of said wagering game, utilizing said bonus pay table in place of said pay table.

* * * * *